US010221366B2

(12) United States Patent
Mukherjee et al.

(10) Patent No.: US 10,221,366 B2
(45) Date of Patent: Mar. 5, 2019

(54) RESIDUE HYDROCRACKING

(71) Applicant: Lummus Technology Inc., Bloomfield, NJ (US)

(72) Inventors: Ujjal K. Mukherjee, Montclair, NJ (US); Mario C. Baldassari, Morris Plains, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 0 days.

(21) Appl. No.: 15/336,108

(22) Filed: Oct. 27, 2016

(65) Prior Publication Data

US 2017/0044448 A1 Feb. 16, 2017

Related U.S. Application Data

(63) Continuation of application No. 13/566,682, filed on Aug. 3, 2012, now abandoned.

(51) Int. Cl.

| | |
|---|---|
| ***C10G 65/12*** | (2006.01) |
| ***C10G 65/14*** | (2006.01) |
| ***C10G 65/00*** | (2006.01) |

(52) U.S. Cl.

CPC ..... *C10G 65/12* (2013.01); *C10G 65/00* (2013.01); *C10G 65/14* (2013.01);
(Continued)

(58) Field of Classification Search

CPC ..... C10G 65/00; C10G 65/12; C10G 65/14; C10G 65/16; C10G 2300/107;
(Continued)

(56) References Cited

U.S. PATENT DOCUMENTS 4,212,771 A * 7/1980 Hamner ..... B01J 21/04 502/254
4,525,267 A 6/1985 Inooka
(Continued)

FOREIGN PATENT DOCUMENTS

WO 02/26917 A1 4/2002

OTHER PUBLICATIONS

Notice of Eligibility for Grant and Final Examination Report dated Apr. 25 2017, issued by the Intellectual Property Office of Singapore in corresponding Singapore Patent Application No. SG-11201500830T (5 pages).

(Continued)

*Primary Examiner* — Prem C Singh
*Assistant Examiner* — Brandi M Doyle
(74) *Attorney, Agent, or Firm* — Osha Liang LLP

(57) ABSTRACT

A process for upgrading residuum hydrocarbons and decreasing tendency of the resulting products toward asphaltenic sediment formation in downstream processes is disclosed. The process may include: contacting a residuum hydrocarbon fraction and hydrogen with a hydroconversion catalyst in a hydrocracking reaction zone to convert at least a portion of the residuum hydrocarbon fraction to lighter hydrocarbons; recovering an effluent from the hydrocracking reaction zone; contacting hydrogen and at least a portion of the effluent with a resid hydrotreating catalyst; and separating the effluent to recover two or more hydrocarbon fractions.

20 Claims, 7 Drawing Sheets

(52) U.S. Cl.
CPC ..... *C10G 2300/107* (2013.01); *C10G 2300/1074* (2013.01); *C10G 2300/1077* (2013.01); *C10G 2300/202* (2013.01)

(58) Field of Classification Search
CPC .... C10G 2300/1074; C10G 2300/1077; C10G 2300/202
See application file for complete search history.

(56) References Cited

U.S. PATENT DOCUMENTS

| | | | | |
|---|---|---|---|---|
| 5,888,379 | A * | 3/1999 | Ushio | C10G 65/04 208/210 |
| 6,447,671 | B1 * | 9/2002 | Morel | C10G 65/04 208/210 |
| 6,454,932 | B1 * | 9/2002 | Baldassari | C10G 65/10 208/153 |
| 2009/0288986 | A1 | 11/2009 | Colyar et al. | |
| 2010/0025293 | A1 | 2/2010 | Kressmann et al. | |
| 2011/0017641 | A1 | 1/2011 | Gupta et al. | |
| 2011/0174691 | A1 | 7/2011 | Reynolds et al. | |
| 2012/0043260 | A1 | 2/2012 | Podrebarac et al. | |

OTHER PUBLICATIONS

Examination Report dated Mar. 21, 2017, issued by the Patent Office of the Cooperation Council for the Arab States of the Gulf, in corresponding GC Patent Application No. GC 2013-25077 (3 pages).
Office Action issued in corresponding Chinese Application No. 201610096149.3 with English translation dated Mar. 17, 2017 (20 pages).
Second Office Action issued in corresponding Canadian Application No. 2,880,515 dated Oct. 19, 2016 (4 pages).
Official Action issued in corresponding Eurasian Application No. 201590314/31 with English translation dated Jun. 8, 2017 (5 pages).
Office Action issued in corresponding Canadian Application No. 2,880,515 dated Jul. 17, 2017 (3 pages).
Extended European Search Report dated Aug. 10, 2016 in corresponding European application No. 13826289.4 (11 pages).
Written Opinion dated Jul. 19, 2016 in corresponding Singapore application No. 11201500830T (5 pages).

* cited by examiner

RESIDUE HYDROCRACKING

CROSS-REFERENCE TO RELATED APPLICATION

This application, pursuant to 35 U.S.C. § 120, claims benefit to U.S. patent application Ser. No. 13/566,682 filed Aug. 3, 2012, which is incorporated herein by reference in its entirety.

FIELD OF THE DISCLOSURE

Embodiments disclosed herein relate generally to processes for hydrocracking residue and other heavy hydrocarbon fractions. More specifically, embodiments disclosed herein relate to processes for cracking residue and other heavy hydrocarbon fractions while simultaneously reducing asphaltenic sediment formation downstream of ebullated bed reactor systems and improving the quality of the conversion products.

BACKGROUND

Attempts to mitigate sediment deposition problems in equipment downstream of ebullated bed reactors, such as separators, exchangers, heaters, and fractionation equipment have used various chemical and mechanical means. However, sediment deposition remains a challenge. Precipitation of asphaltenic material ("sediment") is a major issue in most, if not all, high conversion residue hydrocracking units, especially those utilizing ebullated bed hydrocracking, and often limits the extent of conversion and reduces the on stream factor of many units. Additionally, products from ebullated bed hydrocracking are typically of lower quality, as a significant portion of the conversion occurs as a result of thermal cracking and a contribution of catalytic hydroconversion that improves product quality is somewhat limited.

SUMMARY OF THE CLAIMED EMBODIMENTS

In one aspect, embodiments disclosed herein relate to a process for upgrading residuum hydrocarbons and decreasing tendency of the resulting products toward asphaltenic sediment formation in downstream processes. The process may include: contacting a residuum hydrocarbon fraction and hydrogen with a hydroconversion catalyst in a hydrocracking reaction zone to convert at least a portion of the residuum hydrocarbon fraction to lighter hydrocarbons; recovering an effluent from the hydrocracking reaction zone; contacting hydrogen and at least a portion of the effluent with a resid hydrotreating catalyst; and separating the effluent to recover two or more hydrocarbon fractions.

In another aspect, embodiments disclosed herein relate to a system for upgrading residuum hydrocarbons and decreasing tendency of the resulting products toward asphaltenic sediment formation in downstream processes. The system may include: a hydrocracking reaction zone for contacting a residuum hydrocarbon fraction and hydrogen with a hydroconversion catalyst to convert at least a portion of the residuum hydrocarbon fraction to lighter hydrocarbons and recovering a hydrocracked effluent; a reactor for contacting hydrogen and at least a portion of the hydrocracked effluent with a resid hydrotreating catalyst; and a separation system for separating the effluent to recover two or more hydrocarbon fractions.

In another aspect, embodiments disclosed herein relate to a process for upgrading residuum hydrocarbons and decreasing tendency of the resulting products toward asphaltenic sediment formation in downstream processes. The process may include: contacting a residuum hydrocarbon fraction and hydrogen with a first hydroconversion catalyst in a first hydrocracking reaction zone to convert at least a portion of the residuum hydrocarbon fraction to lighter hydrocarbons and recover a first hydrocracked effluent; quenching the first hydrocracked effluent with at least one of an aromatic diluent and a hydrogen-containing gas stream; separating the quenched first hydrocracked effluent to recover a first overheads vapor fraction comprising distillate hydrocarbons and a first bottoms liquid fraction; contacting hydrogen and the first bottoms liquid fraction with a second hydroconversion catalyst, which may be the same or different than the first hydroconversion catalyst, in a second hydrocracking reaction zone to convert at least a portion of the first bottoms liquid fraction to lighter hydrocarbons and recover a second hydrocracked effluent; contacting hydrogen and at least a portion of the second hydrocracked effluent with a first resid hydrotreating catalyst to form a hydrotreated product; separating the hydrotreated product to recover two or more hydrocarbon fractions.

Other aspects and advantages will be apparent from the following description and the appended claims.

DETAILED DESCRIPTION

In one aspect, embodiments herein relate generally to hydroconversion processes, including processes for hydrocracking residue and other heavy hydrocarbon fractions. More specifically, embodiments disclosed herein relate to hydroconversion processes for treating residue and other heavy hydrocarbon fractions while simultaneously reducing asphaltenic sediment formation downstream of ebullated bed reactor systems and improving the quality of the conversion products.

Hydroconversion processes disclosed herein may be used for reacting residuum hydrocarbon feedstocks at conditions of elevated temperatures and pressures in the presence of hydrogen and one or more hydroconversion catalyst to convert the feedstock to lower molecular weight products with reduced contaminant (such as sulfur and/or nitrogen) levels. Hydroconversion processes may include, for example, hydrogenation, desulfurization, denitrogenation, cracking, conversion, and removal of metals, Conradson Carbon or asphaltenes, etc.

As used herein, residuum hydrocarbon fractions are defined as a hydrocarbon fraction having boiling points or a boiling range above about 343° C. but could also include whole heavy crude processing. Residuum hydrocarbon feedstocks that may be used with processes disclosed herein may include various refinery and other hydrocarbon streams such as petroleum atmospheric or vacuum residue, deasphalted oil, deasphalter pitch, hydrocracked atmospheric tower or vacuum tower bottom, straight run vacuum gas oil, hydrocracked vacuum gas oil, fluid catalytically cracked (FCC) slurry oils, vacuum gas oil from an ebullated bed process, as well as other similar hydrocarbon streams, or a combination of these, each of which may be straight run, process derived, hydrocracked, partially desulfurized, and/or low-metal streams.

Figure 1:
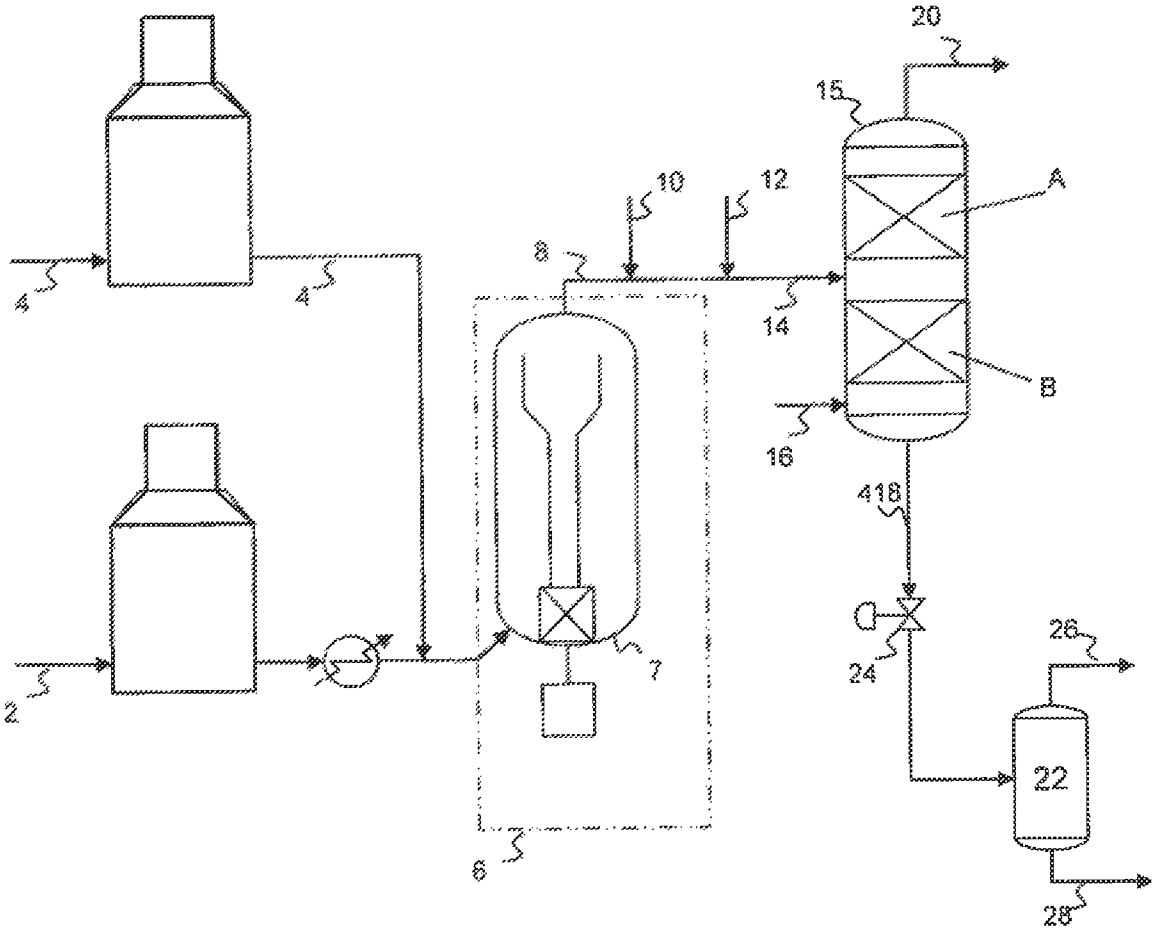
FIG. 1 is a simplified process flow diagram of a process for upgrading residuum hydrocarbon feedstocks according to embodiments disclosed herein.

Referring now to FIG. 1, a residuum hydrocarbon fraction (residue) 2 is heated and mixed with a hydrogen rich treat gas 4 and fed to a hydrocracking stage 6. Hydrocracking stage 6 may include a single ebullated bed reactor 7, as illustrated, or may include multiple reactors arranged in parallel and/or series. In ebullated bed reactor(s) 7, the residuum hydrocarbon fraction may be hydrocracked under hydrogen partial pressures of 70 to 170 bara, temperatures of 380° C. to 450° C., and a LHSV of 0.15 to 2.0 $h^{-1}$ in the presence of a hydroconversion catalyst.

Within the ebullated bed reactor 7, the catalyst is backmixed and maintained in random motion by the recirculation of liquid product. This is accomplished by first separating the recirculated oil from the gaseous products. The oil is then recirculated by means of an external pump or a pump having an impeller mounted in the bottom head of the reactor.

Target residue conversion in the first hydrocracking stage may typically be in the range from about 30 wt % to about 75 wt %, depending upon the feedstock being processed. However, conversion should be maintained below the level where sediment formation becomes excessive. In addition to converting the residue, it is anticipated that sulfur removal will be in the range from about 40% to about 80%, metals removal will be in the range from about 40% to about 85%, and Conradson Carbon Removal (CCR) will be in the range from about 40% to about 65% in the first hydrocracking stage 6.

Liquid and vapor effluent from the first hydrocracking stage 6 may be recovered via flow line 8 and quenched with an aromatic solvent 10 and or a hydrogen-containing gas stream 12. Aromatic solvent 10 may include any aromatic solvent, such as slurry oil from a Fluid Catalytic Cracking (FCC) process or sour vacuum residue, among others.

The quenched effluent 14 is then fed to a countercurrent reactor/stripper 15 loaded with hydroprocessing (hydrotreating) catalyst(s). The heavy liquid from the first stage reactor effluent traverses downward within the reactor/stripper 15, passes through the lower catalyst zone B, containing a residue hydrotreating catalyst, and comes into contact with hydrogen, fed via flow line 16, travelling in a countercurrent manner up the reactor/stripper. Additional hydrodemetallization (HDM), hydrodesulfurization (HDS), Conradson Carbon Reduction (HDCCR), hydrodearomatization (HDA), and other reactions occur in catalyst zone B, resulting in a bottoms fraction 18 more amenable to downstream processing. Catalyst zone B may include a packed catalyst bed, impregnated structured packing, and other forms typical for containing catalyst within a catalytic distillation reactor system.

The light distillates in the vapor phase entering the reactor/stripper 15 traverse upward within the reactor stripper 15, passing through upper catalyst zone A, contacting hydrogen travelling in a co-current manner up the reactor stripper. The catalyst in catalyst zone A may include a distillate hydrotreating catalyst, and may provide incremental HDS, HDN and HDA capability, further improving the quality of the light distillates recovered. The vapor fraction, light distillates and unreacted hydrogen, may be recovered from reactor/stripper 15 via flow line 20 and routed through a gas cooling, purification, and recycle gas compression system (not shown). Alternatively, the vapor fraction 20 may be first processed through an integrated hydroprocessing reactor system (not shown), alone or in combination with external distillates and/or distillates generated in the hydrocracking process, and, thereafter, muted to the gas cooling, purification, and compression system (not shown).

Bottoms fraction 18 recovered from reactor/stripper 15 may then be flashed in flash vessel 22, where the pressure of the fluid may be decreased across control valve 24, for example, before entering the flash vessel. This flashing results in a vapor fraction 26, with may be routed to an atmospheric distillation system after cooling along with other distillate products recovered from the gas cooling and purification system. The liquid fraction 28 may be further stripped to recover additional atmospheric distillates, producing a stripped heavy unconverted oil product similar to an atmospheric tower bottoms product, having a boiling point in the range from about 343° C. to about 427° C. which may then be sent to a vacuum distillation system to recover vacuum distillates.

Figure 2A:
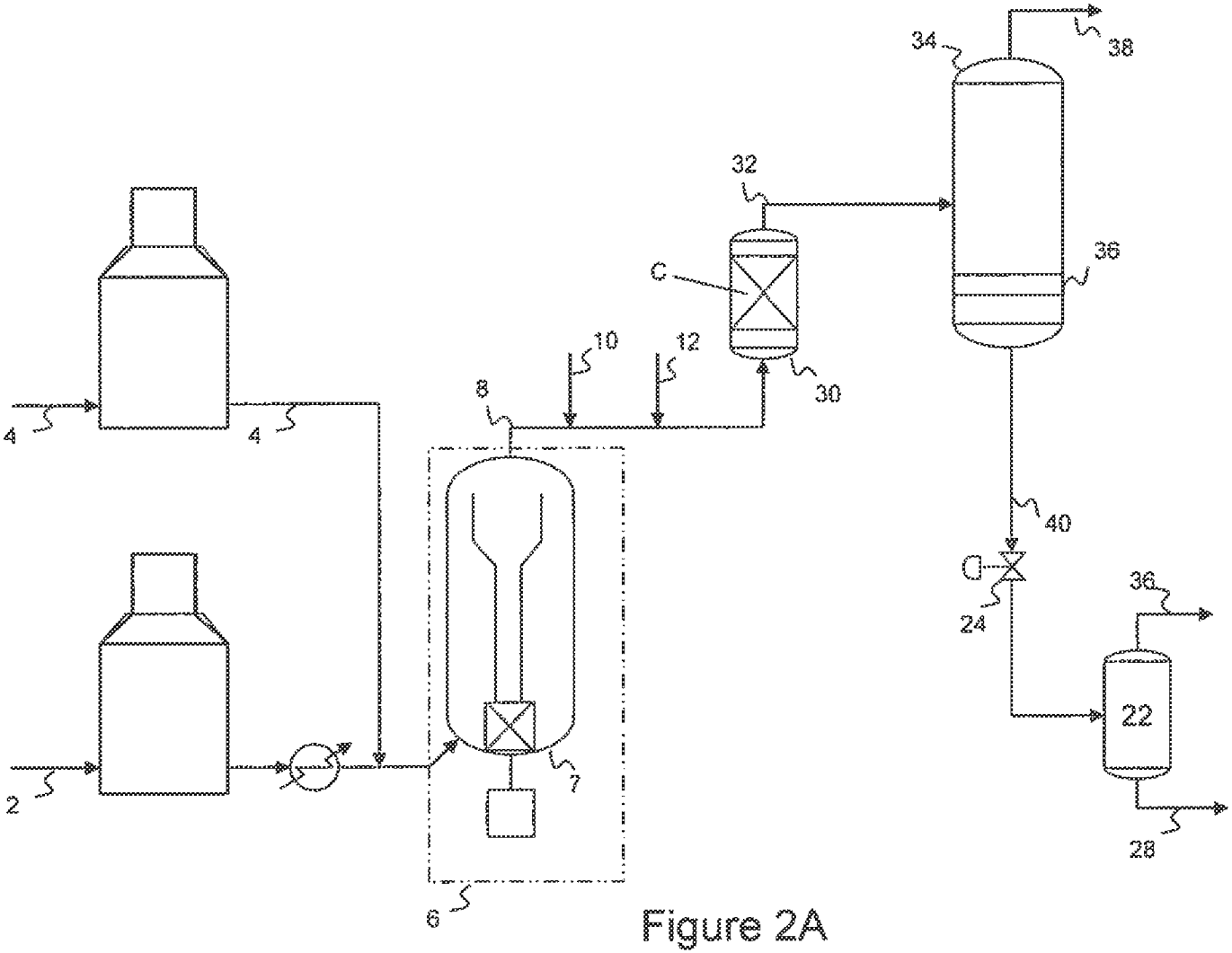
FIG. 2A is a simplified process flow diagram of a process for upgrading residuum hydrocarbon feedstocks according to embodiments disclosed herein.
Figure 2B:
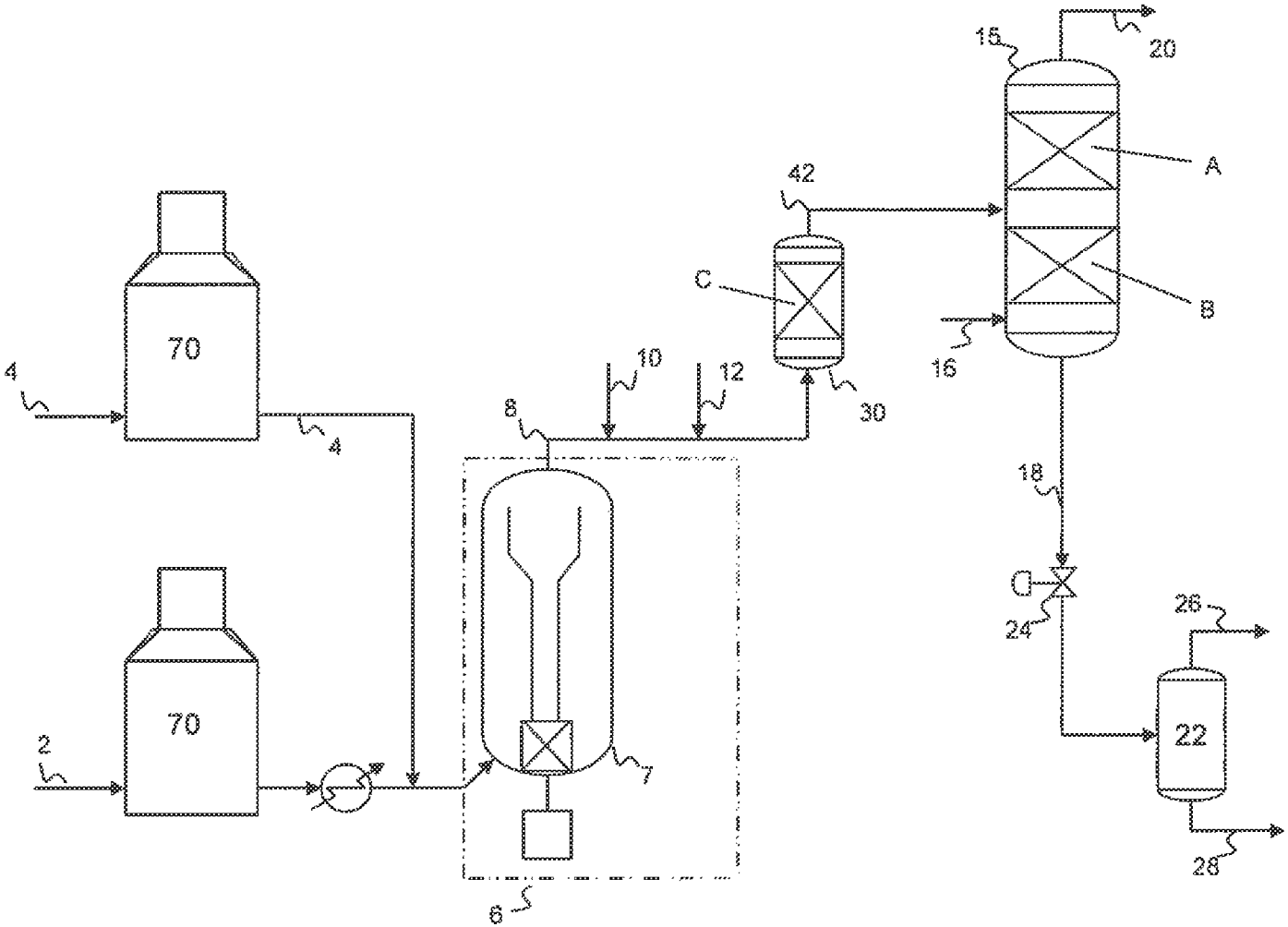
FIG. 2B is a simplified process flow diagram of a process for upgrading residuum hydrocarbon feedstocks according to embodiments disclosed herein.

Referring now to FIGS. 2A and 2B, where like numerals represent like parts. as an alternative to reactor/stripper 15, the liquid and vapor effluent 8 from the first hydrocracking stage 6 may be quenched using an aromatic solvent and/or hydrogen and fed to an upflow reactor or OCR (on-line catalyst replacement) reactor 30 having a catalyst zone C containing a residue hydroprocessing catalyst, providing additional HDM, HDS, HDCCR, and HDA, among other reactions, improving the quality of the effluent. As compared with an upflow reactor the application of an OCR reactor permits catalyst to be added and withdrawn on-stream in a similar manner to that routinely practiced in ebullated bed hydrocracking reactors. In this way reactor volume can be reduced and constant product quality can be maintained over the course of the operation without necessitating the shutdown of the unit to replace the catalyst inventory.

In some embodiments, such as illustrated in FIG. 2A, the effluent from upflow reactor 30 may be fed via flow line 32 to a vapor/liquid separator 34, which may optionally contain a packing zone 36 where it is contacted with hydrogen rich gas 37. Light distillates may be recovered from vapor/liquid separator 34 via flow line 38 and routed through a gas cooling, purification, and recycle gas compression system (not shown), as described above. Alternatively, the vapor fraction 38 may be first processed through an integrated hydroprocessing reactor system (not shown), alone or in combination with external distillates and/or distillates generated in the hydrocracking process, and, thereafter, routed to the gas cooling, purification, and compression system (not shown). Heavy distillates may be recovered from vapor/liquid separator 34 via flow line 40 and processed as described with respect to flash vessel 22 for FIG. 1.

In other embodiments, such as illustrated in FIG. 2B, the effluent from upflow or OCR reactor 30 may be fed via flow line 42 to a reactor/stripper 15, including an upper catalyst zone A and a lower catalyst zone B, as described above with respect to FIG. 1.

Figure 3:
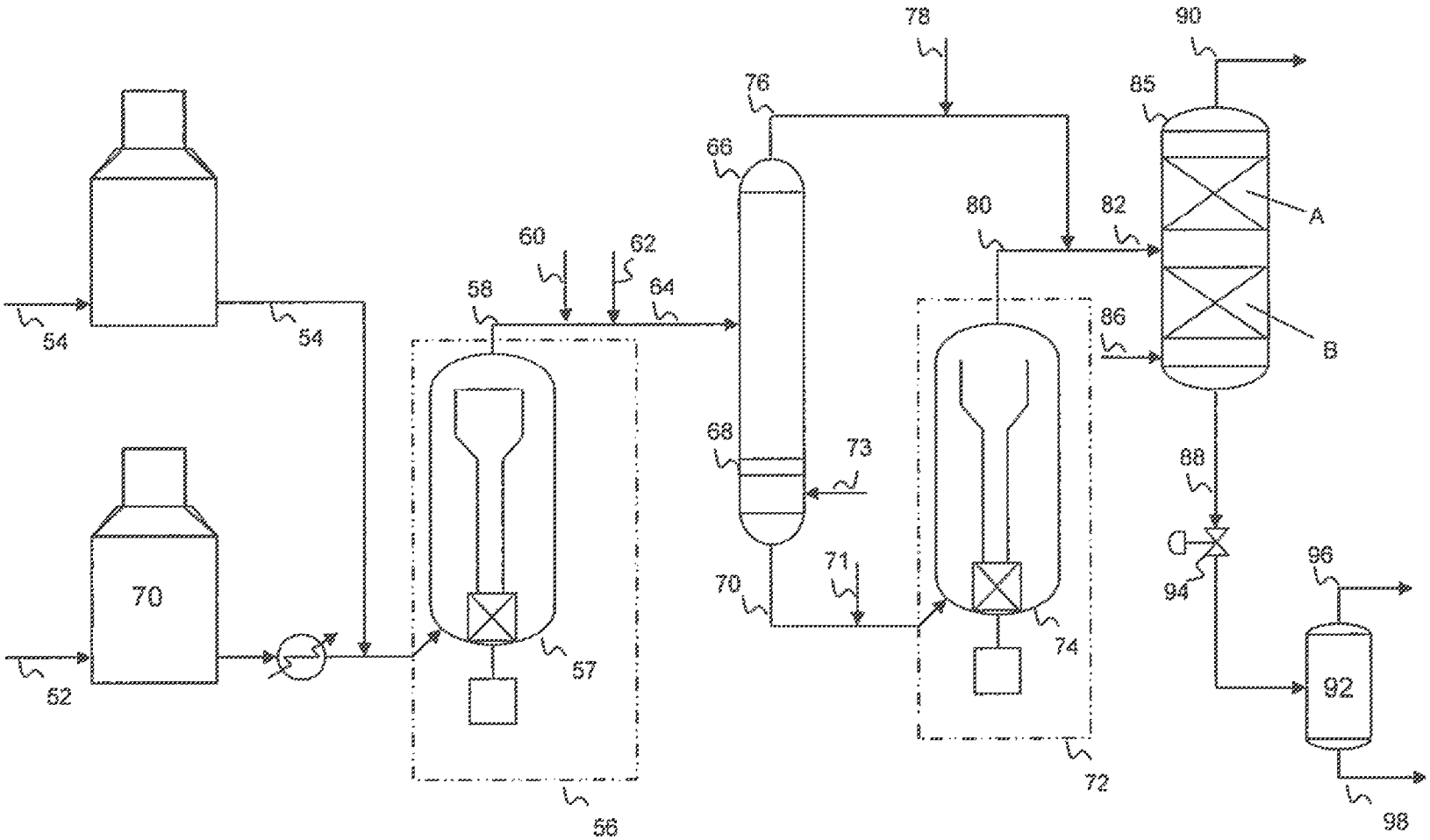
FIG. 3 is a simplified process flow diagram of a process for upgrading residuum hydrocarbon feedstocks according to embodiments disclosed herein.

As noted above, hydroprocessing systems according to embodiments disclosed herein may include one or more hydrocracking stages. Referring now to FIG. 3, one embodiment of a hydroprocessing process according to embodiments herein is illustrated, including an intermediate vapor/liquid separator and a reactor/stripper following the last hydrocracking stage.

A residuum hydrocarbon fraction (residue) 52 is heated and mixed with a hydrogen rich treat gas 54 and fed to a hydrocracking stage 56. Hydrocracking stage 56 may include a single ebullated bed reactor 57, as illustrated, or may include multiple reactors arranged in parallel and/or series. In ebullated bed reactor(s) 57, the residuum hydrocarbon fraction may be hydrocracked under hydrogen partial pressures of 70 to 170 bara, temperatures of 380° C. to 450° C., and a LHSV of 0.25 to 2.0 $h^{-1}$ in the presence of a hydroconversion catalyst.

Within the ebullated bed reactor 57, the catalyst is back-mixed and maintained in random motion by the recirculation of liquid product. This is accomplished by first separating the recirculated oil from the gaseous products. The oil is then recirculated by means of an external pump or a pump having an impeller mounted in the bottom head of the reactor.

Target residue conversion in the first hydrocracking stage may typically be in the range from about 30 wt % to about 75 wt %, depending upon the feedstock being processed. However, conversion should be maintained below the level where sediment formation becomes excessive. In addition to converting the residue, it is anticipated that sulfur removal will be in the range from about 40% to about 75%, metals removal will be in the range from about 40% to about 80%, and Conradson Carbon Removal (CCR) will be in the range from about 40% to about 60% in the first hydrocracking stage 56.

Liquid and vapor effluent from the first hydrocracking stage 56 may be recovered via flow line 58 and quenched with an aromatic solvent 60 or hydrogen rich gas 62. Aromatic solvent 60 may include any aromatic solvent, such as slurry oil from a Fluid Catalytic Cracking (FCC) process or sour vacuum residue, among others.

The quenched effluent 64 is then fed to an intermediate vapor/liquid separator 66, which may optionally contain a packing section 68, where the intermediate heavy unconverted liquid is further contacted with hydrogen rich gas 73. The heavy liquid from the first hydrocracking stage effluent may then be recovered as a bottoms fraction 70 from vapor liquid separator 66, combined with hydrogen 71, and fed to a second hydrocracking stage 72, which may include one or more ebullated bed reactors 74, where systems with multiple reactors may include parallel and/or series arrangements. Ebullated bed reactors 74 may operate in a similar manner as described above, providing incremental conversion of the heavy liquids to vacuum gas oils and other light products.

Target residue conversion exiting the second hydrocracking stage may typically be in the range from about 50 wt % to about 85 wt %, depending upon the feedstock being processed. However, conversion should be maintained below the level where sediment formation becomes excessive. In addition to converting the residue, it is anticipated that overall sulfur removal exiting the second hydrocracking stage 72 will be in the range from about 60% to about 85%, metals removal will be in the range from about 60% to about 92%, and Conradson Carbon Removal (CCR) will be in the range from about 50% to about 75%.

Vapor product 76 recovered from vapor/liquid separator 66 may be quenched with an aromatic solvent and/or hydrogen rich gas 78 and combined with the vapor and liquid effluent 80 recovered from the last hydrocracking stage (or last ebullated bed reactor within a hydrocracking stage). The combined quenched products may be fed via flow line 82 to a reactor/stripper 85 intermediate an upper catalyst zone A and a lower catalyst zone B.

The heavy liquid in the combined quenched stream 82 traverses downward within the reactor/stripper 85, passes through the lower catalyst zone B, containing a residue hydrotreating catalyst, and comes into contact with hydrogen, fed via flow line 86, travelling in a countercurrent manner up the reactor/stripper. Additional hydrodemetallization (HDM), hydrodesulfurization (HDS), Conradson Carbon Reduction (HDCCR), hydrodearomatization (HDA), and other reactions occur in the fixed catalyst zone B, resulting in a bottoms fraction 88 more amenable to downstream processing. Catalyst zone B may include a packed catalyst bed, impregnated structured packing, and other forms typical for containing catalyst within a catalytic distillation reactor system.

The light distillates in the vapor phase entering the reactor/stripper 85 traverse upward within the reactor stripper 85, passing through upper catalyst zone A, contacting hydrogen travelling in a co-current manner up the reactor stripper. Catalyst zone A may include a distillate hydrotreating catalyst, and may provide incremental HDS, HDN and HDA capability, further improving the quality of the light distillates recovered. The vapor fraction, light distillates and unreacted hydrogen, may be recovered from reactor/stripper 85 via flow line 90 and routed through a gas cooling, purification, and recycle gas compression system (not shown). Alternatively, the vapor fraction 90 may be first processed through an integrated hydroprocessing reactor system (not shown), alone or in combination with external distillates and/or distillates generated in the hydrocracking process, and, thereafter, routed to the gas cooling, purification, and compression system (not shown).

Bottoms fraction 88 recovered from reactor/stripper 85 may then be flashed in flash vessel 92, where the pressure of the fluid may be decreased across control valve 94, for example, before entering the flash vessel. This flashing results in a vapor fraction 96 which may be routed to an atmospheric distillation system after cooling along with other distillate products recovered from the gas cooling and purification system. The liquid fraction 98 may be further stripped to recover additional atmospheric distillates, producing a stripped heavy unconverted oil product, similar to an atmospheric tower bottoms product, having a boiling point in the range from about 343° C. to about 427° C., which may then be sent to a vacuum distillation system to recover vacuum distillates.

In an alternative embodiment, the vapor and liquid effluent 80, with or without the vapor fraction 76, may be processed using an upflow or OCR reactor (not illustrated) and separated similar to the embodiments described with respect to FIGS. 2A and 2B. The additional conversion and enhanced HDA, HDM, HDCCR, and HDS achieved using the upflow reactor (with catalyst zone C) and/or the reactor/stripper (with catalyst zones A and B) following the last hydrocracking stage provides significant benefits over mere separation of the combined hydrocracking stage effluents, improving the quality of the resulting products and making the resulting products more amenable to downstream processing.

Figure 4:
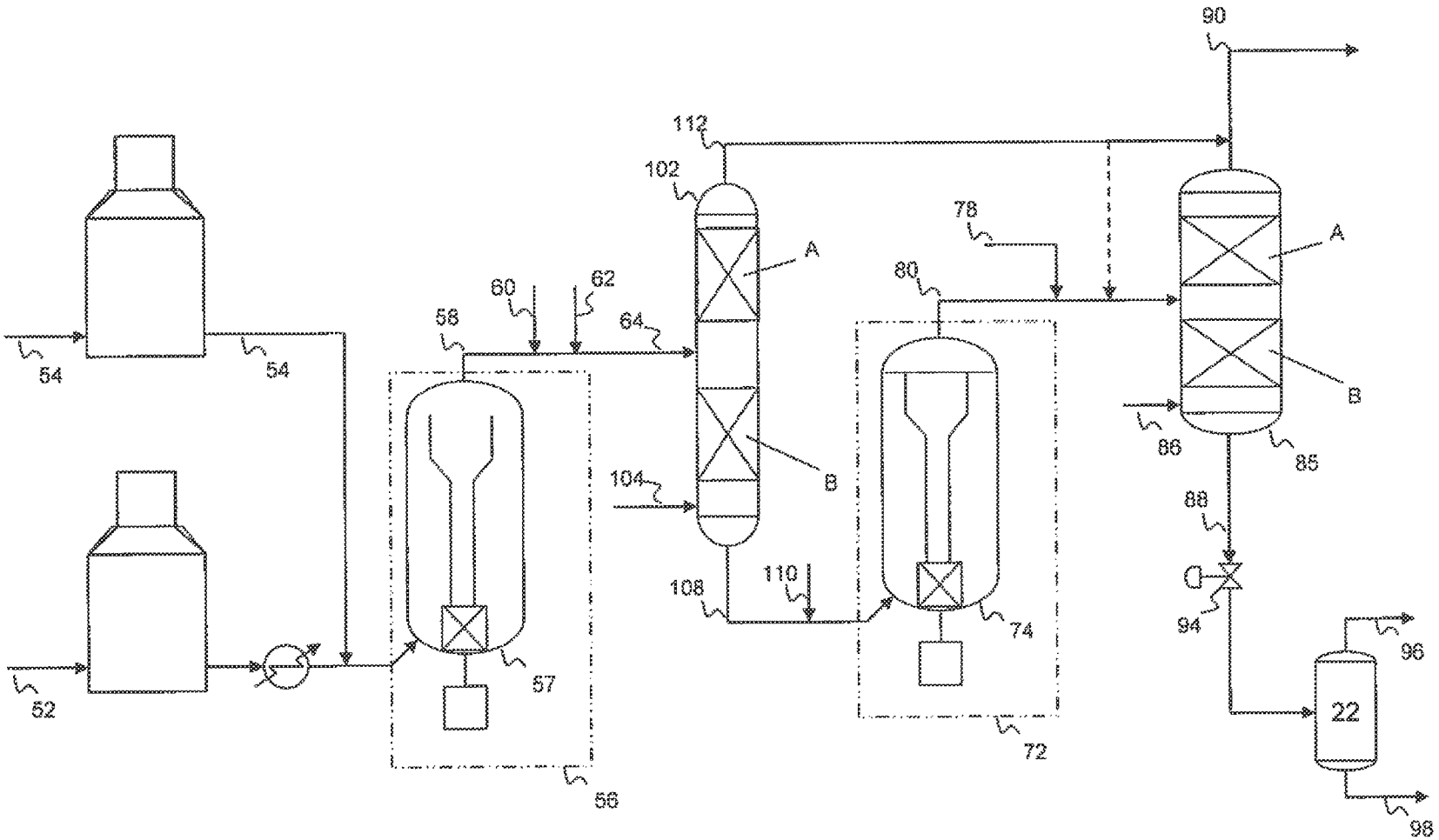
FIG. 4 is a simplified process flow diagram of a process for upgrading residuum hydrocarbon feedstocks according to embodiments disclosed herein.
Figure 5:
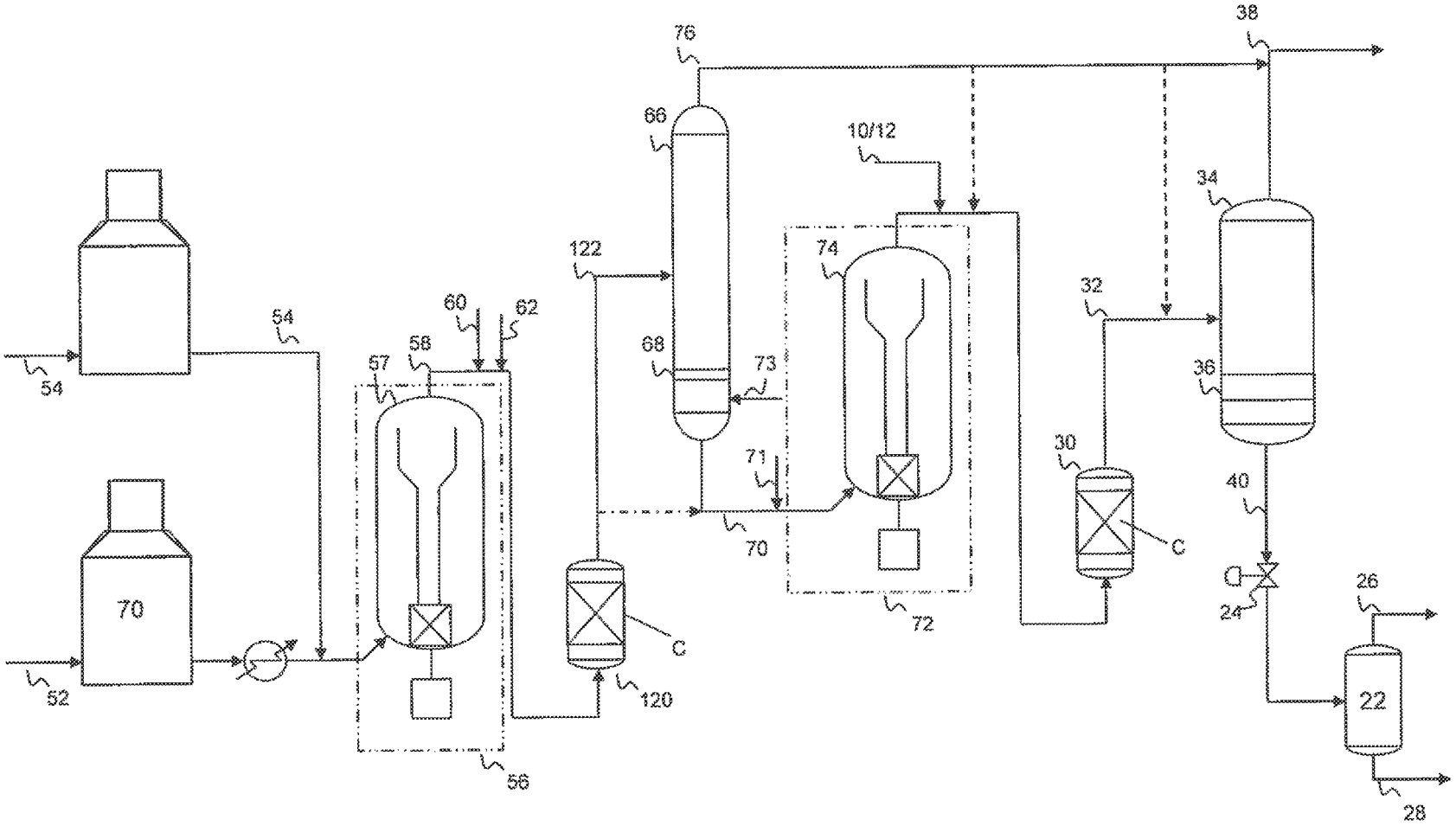
FIG. 5 is a simplified process flow diagram of a process for upgrading residuum hydrocarbon feedstocks according to embodiments disclosed herein.
Figure 6:
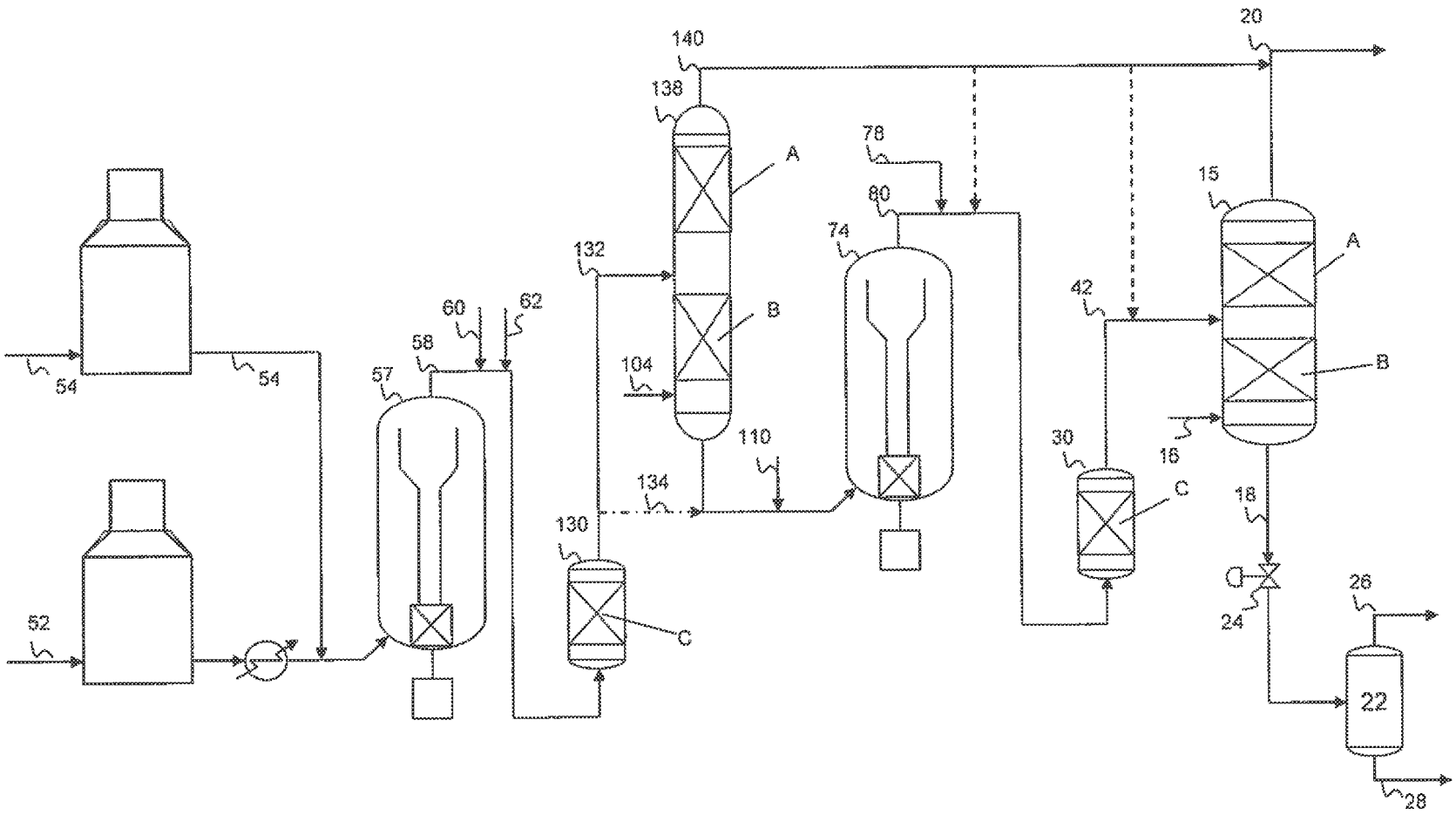
FIG. 6 is a simplified process flow diagram of a process for upgrading residuum hydrocarbon feedstocks according to embodiments disclosed herein.

In addition to the benefits that may be received using the upflow or distillation reactor systems following the last hydrocracking stage, further benefits may be realized by use of upflow and/or distillation reactor systems intermediate the first and second (and/or between subsequent) hydrocracking stages, as illustrated in FIGS. 4-6, where like numerals represent like parts.

Referring now to FIG. 4, as opposed to separating vapor products from the liquid products in first hydrocracking stage 56 effluent 58 via an intermediate vapor/liquid separator 66, the first hydrocracking stage 56 effluent 58 may be fed to a reactor/stripper 102 containing an upper catalyst zone A and a lower catalyst zone B. Hydrogen may be introduced to reactor/stripper 102 via flow line 104, for example. The liquid and vapor effluent from the first hydrocracking stage effluent 58 may be quenched using an aromatic solvent and/or quench gas 60 and fed to a countercurrent reactor/stripper containing hydroprocessing catalyst(s). The heavy liquid from the from the first stage reactor effluent traverses downward within the reactor/stripper 102, passes through the lower catalyst zone B, containing a residue hydrotreating catalyst, and comes into contact with hydrogen, fed via flow line 104, travelling in a countercurrent manner up the reactor/stripper. Additional hydrodemetallization (HDM), hydrodesulfurization (HDS), Conradson Carbon Reduction (HDCCR), hydrodearomatization (HDA), and other reactions occur in the catalyst zone B. A bottoms fraction 108 may be recovered from the reactor/stripper 102, combined with hydrogen 110, and fed to the second hydrocracking stage 72 for further processing as described above.

The light distillates in the vapor phase entering the reactor/stripper 102 traverse upward within the reactor/stripper 102, passing through upper catalyst zone A, contacting hydrogen travelling in a co-current manner up the reactor/stripper. Catalyst zone A may include a distillate hydrotreating catalyst, and may provide incremental HDS, HDN and HDA capability, further improving the quality of the light distillates recovered. The vapor fraction 112, light distillates and unreacted hydrogen recovered from reactor/stripper 102, may be further processed in reactor/stripper 85 along with the second hydrocracking stage effluent or fed to the common gas cooling, purification, and recycle gas processing system as described above.

Similarly, the first hydrocracking stage effluent may be quenched and fed to an upflow or OCR reactor 120, as illustrated in FIG. 5, contacting the hydrocracking effluent 58 with a hydroprocessing catalyst in catalyst zone C to result in additional conversion, HDM, HDS, HDCCR, and/or HDA. The effluent 122 may then be fed to an intermediate vapor/liquid separator 66 and processed as described above with respect to the respective portions of FIG. 3. The second hydrocracking stage effluent 80 and the vapor recovered from intermediate vapor/liquid separator may then be processed as described above with respect to the respective portions of any one of FIGS. 1, 2A (as illustrated in FIG. 5), 2B, and 3, where additional processing of the vapor recovered from vapor/liquid separator 66, if desired, may be accomplished by feeding a portion or all of the vapor fraction 122 to the downstream upflow or OCR reactor and/or reactor/stripper.

As a further alternative, processing of the intermediate effluent recovered from the first hydrocracking stage may be performed as illustrated in FIG. 6. In this embodiment, the first hydrocracking stage effluent may be quenched with an aromatic solvent and/or hydrogen gas and fed to an upflow or OCR reactor 130. The effluent 132 may be fed directly to second hydrocracking stage 72 via flow line 134, or may be fed via flow line 136 to reactor/stripper 138 containing an upper catalyst zone A and a lower catalyst zone B, for treatment and separation similar to that described above with respect to reactor/stripper 102 (FIG. 4). The vapor fraction 140, light distillates and unreacted hydrogen recovered from reactor/stripper 138, and the second hydrocracking stage effluent 80 may then be processed as described above with respect to any one of FIGS. 1, 2A, 2B (as illustrated in FIG. 6), and 3, where additional processing of the vapor recovered from vapor/liquid separator 138, if desired, may be accomplished by feeding a portion or all of the vapor fraction 140 to the downstream upflow or OCR reactor and/or reactor/stripper.

Hydroconversion catalysts that may be used in catalyst zones A, B, and C include catalyst that may be used for the hydrotreating or hydrocracking of a hydrocarbon feedstock. A hydrotreating catalyst, for example, may include any catalyst composition that may be used to catalyze the hydrogenation of hydrocarbon feedstocks to increase its hydrogen content and/or remove heteroatom contaminants. A hydrocracking catalyst, for example, may include any catalyst composition that may be used to catalyze the addition of hydrogen to large or complex hydrocarbon molecules as well as the cracking of the molecules to obtain smaller, lower molecular weight molecules.

Hydroconversion catalyst compositions for use in the hydroconversion process according to embodiments disclosed herein are well known to those skilled in the art and several are commercially available from W.R. Grace & Co., Criterion Catalysts & Technologies, and Albemarle, among others. Suitable hydroconversion catalysts may include one or more elements selected from Groups 4-12 of the Periodic Table of the Elements. In some embodiments, hydroconversion catalysts according to embodiments disclosed herein may comprise, consist of, or consist essentially of one or more of nickel, cobalt, tungsten, molybdenum and combinations thereof, either unsupported or supported on a porous substrate such as silica, alumina, titania, or combinations thereof. As supplied from a manufacturer or as resulting from a regeneration process, the hydroconversion catalysts may be in the form of metal oxides, for example. In some embodiments, the hydroconversion catalysts may be presulfided and/or pre-conditioned prior to introduction to the hydrocracking reactor(s).

Distillate hydrotreating catalyst that may be useful in catalyst zone A may include catalyst selected from those elements known to provide catalytic hydrogenation activity. At least one metal component selected from Group 8-10 elements and/or from Group 6 elements is generally chosen. Group 6 elements may include chromium, molybdenum and tungsten. Group 8-10 elements may include iron, cobalt, nickel, ruthenium, rhodium, palladium, osmium, iridium and platinum. The amount(s) of hydrogenation component(s) in the catalyst suitably range from about 0.5% to about 10% by weight of Group 8-10 metal component(s) and from about 5% to about 25% by weight of Group 6 metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group 6 and a Group 8 metal component is present as (mixed) oxides, it will be subjected to a sulfiding treatment prior to proper use in hydrocracking. In some embodiments, the catalyst comprises one or more components of nickel and/or cobalt and one or more components of molybdenum and/or tungsten or one or more components of platinum and/or palladium. Catalysts containing nickel and molybdenum, nickel and tungsten, platinum and/or palladium are useful.

Residue hydrotreating catalyst that may be useful in catalyst zone B may include catalysts generally composed of a hydrogenation component, selected from Group 6 elements (such as molybdenum and/or tungsten) and Group 8-10 elements (such as cobalt and/or nickel), or a mixture thereof, which may be supported on an alumina support. Phosphorous (Group 15) oxide is optionally present as an active ingredient. A typical catalyst may contain from 3 to 35 wt % hydrogenation components, with an alumina binder. The catalyst pellets may range in size from 1/32 inch to 1/8 inch, and may be of a spherical, extruded, trilobate or quadrilobate shape. In some embodiments, the feed passing through the catalyst zone contacts first a catalyst preselected for metals removal, though some sulfur, nitrogen and aromatic removal may also occur. Subsequent catalyst layers may be used for sulfur and nitrogen removal, though they would also be expected to catalyze the removal of metals and/or cracking reactions. Catalyst layer(s) for demetallization, when present, may comprise catalyst(s) having an average pore size ranging from 125 to 225 Angstroms and a pore volume ranging from 0.5-1.1 $cm^3/g$. Catalyst layer(s) for denitrification/desulfurization may comprise catalyst(s) having an average pore size ranging from 100 to 190 Angstroms with a pore volume of 0.5-1.1 $cm^3/g$. U.S. Pat. No. 4,990,243 describes a hydrotreating catalyst having a pore size of at least about 60 Angstroms, and preferably from about 75 Angstroms to about 120 Angstroms. A demetallation catalyst useful for the present process is described, for example, in U.S. Pat. No. 4,976,848, the entire disclosure of which is incorporated herein by reference for all purposes. Likewise, catalysts useful for desulfurization of heavy streams are described, for example, in U.S. Pat. Nos. 5,215,955 and 5,177,047, the entire disclosures of which is incorporated herein by reference for all purposes. Catalysts useful for desulfurization of middle distillate, vacuum gas oil streams and naphtha streams are described, for example, in U.S. Pat. No. 4,990,243, the entire disclosures of which are incorporated herein by reference for all purposes.

Residue hydrotreating catalyst useful in catalyst zone C may include catalysts comprising a porous refractory base made up of alumina, silica, phosphorous, or various combinations of these. One or more types of catalysts may be used as residue hydrotreating catalyst C, and where two or more catalysts are used, the catalysts may be present in the reactor zone as layers. The catalysts in the lower layer(s) may have good demetallation activity. The catalysts may also have hydrogenation and desulfurization activity, and it may be advantageous to use large pore size catalysts to maximize the removal of metals. Catalysts having these characteristics are not optimal for the removal of carbon residue and sulfur. The average pore size for catalyst in the lower layer or layers will usually be at least 60 Angstroms and in many cases will be considerably larger. The catalyst may contain a metal or combination of metals such as nickel, molybdenum, or cobalt. Catalysts useful in the lower layer or layers are described in U.S. Pat. No. 5,071,805 5,215,955, and 5,472,928. For example, those catalysts as described in U.S. Pat. No. 5,472,928 and having at least 20% of the pores in the range of 130 to 170 Angstroms, based on the nitrogen method, may be useful in the lower catalysts layer(s). The catalysts present in the upper layer or layers of the catalyst zone should have greater hydrogenation activity as compared to catalysts in the lower layer or layers. Consequently catalysts useful in the upper layer or layers may be characterized by smaller pore sizes and greater carbon residue removal, denitrification and desulfurization activity. Typically, the catalysts will contain metals such as, for example, nickel, tungsten, and molybdenum to enhance the hydrogenation activity. For example, those catalysts as described in U.S. Pat. No. 5,472,928 and having at least 30% of the pores in the range of 95 to 135 Angstroms, based on the nitrogen method, may be useful in the upper catalysts layers. The catalysts may be shaped catalysts or spherical catalysts. In addition, dense, less friable catalysts may be used in the upflow fixed catalyst zones to minimize breakage of the catalyst particles and the entrainment of particulates in the product recovered from the reactor.

One skilled in the art will recognize that the various catalyst layers may not be made up of only a single catalyst, but may be composed of an intermixture of different catalysts to achieve the optimal level of metals or carbon residue removal and desulfurization for that layer. Although some hydrogenation will occur in the lower portion of the zone, the removal of carbon residue, nitrogen, and sulfur may take place primarily in the upper layer or layers. Obviously additional metals removal also will take place. The specific catalyst or catalyst mixture selected for each layer, the number of layers in the zone, the proportional volume in the bed of each layer, and the specific hydrotreating conditions selected will depend on the feedstock being processed by the unit, the desired product to be recovered, as well as commercial considerations such as cost of the catalyst. All of these parameters are within the skill of a person engaged in the petroleum processing industry and should not need further elaboration here.

EXAMPLES

Example 1

A first theoretical example is described with reference to FIG. 1 illustrating the effect the addition of a reactor/stripper has on the heavy unconverted oil and distillate product qualities. Specifically in this example the ebullated bed hydrocracking stage operates at a liquid hourly space velocity of 0.25 hr-1 and a temperature between 425° C. and 432° C., converting between 65 to 73% of the vacuum residue fraction in the feed. In addition approximately 75% of sulfur, 80% of the metals, 60% of the CCR and 65% of the asphaltenes in the residue feed is removed in this hydrocracking stage.

The resulting heavy unconverted oil product after quenching then flows downward through the residue hydrotreating catalyst bed where it contacts hydrogen flowing upward and countercurrent to the unconverted oil which undergoes further reaction. In this bed the unconverted residue fraction undergoes further desulfurization, demetallation and Conradson Carbon Reduction and asphaltene conversion reactions. In addition any remaining free radicals formed as a result of the thermal cracking occurring in the upstream hydrocracking stage are saturated reducing coke precursor and sediment formation, thereby improving the stability of the resultant unconverted oil product.

In particular it is envisaged that the residue hydrotreatment reaction bed will operate at a LHSV of between 4 to 8 hr-1 and a WABT (i.e., weighted average bed temperature)

of 380° C. to 400° C. with a gas flow ranging between 70 to 100 Nm3/m3 of feed. As a result it is estimated sulfur, CCR and metals removal will all increase by 1 to 2%. More importantly, however, sediment formation will be suppressed by 15 to 20%.

The light distillates in the vapor phase entering the reactor/stripper along with lighter distillate fractions stripped from the unconverted oil in the residue hydrotreatment reaction bed flow up through the distillate hydrotreatment bed along with hydrogen contained in the effluent from the hydrocracking reaction stage plus excess hydrogen exiting the top of the residue hydrotreatment bed. It is estimated that about 50% of the distillate formed in the hydrocracking reaction stage will be in the vapor phase flow to the distillate hydrotreatment bed. This will contain the vast majority of the naphtha boiling range material, between 50 to 60% of the diesel boiling range material and about 25 to 30% of the vacuum gasoil fraction. In particular it is envisaged that the distillate hydrotreatment bed will operate at a LHSV ranging from 1.6 to 2.5 hr-1 and a WABT ranging from 360° C. to 390° C. At these operating conditions HDS and HDN removals will exceed 99%, producing a naphtha fraction with <1 wppm sulfur and nitrogen and an ultra low sulfur diesel product with <10 wppm sulfur.

Example 2

A second theoretical example is described with reference to FIG. 2B illustrating the combined effect the addition of an upflow or OCR reactor and subsequent reactor/stripper has on residue conversion, reaction yields and heavy unconverted oil and distillate product qualities. As in Example 1, it is envisaged that the ebullated bed hydrocracking stage operates at a LHSV of 0.25 hr-1 and a temperature of 425° C. to 432° C., converting between 65 and 73 of the vacuum residue fraction in the feed. In addition, as in Example 1 approximately 75% of the sulfur, 80% of the metals, 60% of the CCR and 65% of the asphaltenes in the residue feed is removed in the hydrocracking stage.

In Example 2, the liquid and vapor effluent from the hydrocracking reaction stage after being quenched is further processed in an upflow reactor, containing residue hydroprocessing catalyst, thereby providing for additional sulfur, metals, CCR and asphaltene removal. It is envisaged that the upflow reactor will operate at a LHSV of 1.0 to 2.0 hr-1 and a temperature between 380° C. to 400° C. At these conditions the vacuum residue conversion will increase by an additional 1 to 2%. In addition to the increased residue conversion, HDS removals will increase from 3.5 to 5.5%, CCR and asphaltene removals will increase 4 to 7%, and metals removals will increase from 5 to 7%. As a result of the increased CCR and asphaltene conversion and the inhibition of coke precursor formation, the sediment content of the unconverted oil is expected to decline by as much as 50% significantly improving the stability of the unconverted oil product.

As in Example 1, the resultant heavy unconverted oil and light distillates undergo further treatment in a reactor/stripper at similar conditions and with similar product quality improvements as outlined previously. In summary, therefore, as a result of adding an upflow or OCR reactor and a reactor/stripper overall conversion and removals and product qualities are expected to increase as defined in the table below:

| Parameter | Ebullated Bed Resid Hydrocracking Stage | Upflow/OCR Reactor + Reactor/Stripper |
|---|---|---|
| LHSV, hr−1 | | |
| EB Hydrocracking Stage | 0.25 | |
| Upflow/OCR Reactor | | 1.0-2.0 |
| Reactor/Stripper | | |
| Lower Bed | | 4-8 |
| Upper Bed | | 1.6-2.5 |
| Temperature, ° C. | | |
| EB Hydrocracking Stage | 425-432 | |
| Upflow/OCR Reactor | | 380-400 |
| Reactor/Stripper | | |
| Lower Bed | | 380-400 |
| Upper Bed | | 360-390 |
| HDS Removal, wt % | 75 | 79.5-82.5 |
| CCR Removal, wt % | 60 | 65-69 |
| HDM Removal, wt % | 80 | 85-87 |
| Asphaltene Removal, wt % | 65 | 70-74 |
| Heavy Unconverted Oil Sediments (SHFT), wt % | X | <0.5X |
| Naphtha Product | | |
| Nitrogen, wppm | | <1 |
| Sulfur, wppm | | <1 |
| Diesel Product Sulfur, wppm | | <10 |

As described above, use of a reactor/stripper and/or an upflow reactor may provide for an enhanced degree of conversion, HDS, HDA, HDM, and HDCCR. This may improve the quality of the hydrocarbon product and reduce the tendency of the product for asphaltenic sediment formation in downstream equipment.

Although the processes described above include one or two hydrocracking stages, embodiments including more than two stages are contemplated herein. Further, embodiments disclosed herein illustrate multi-stage processing of the resid feeds with and without use of an interstage vapor-liquid separation (via a vapor/liquid separator or a reactor/stripper). While enhanced conversion and improved product quality may be realized using these intermediate steps, the additional conversion, HDS, HDA, HDM, and HDCCR realized using the upflow reactor and/or reactor/stripper following the last hydrocracking stage may sufficiently reduce the tendency of asphaltenic sedimentation in downstream equipment.

Advantageously, embodiments disclosed herein integrate fixed bed and ebullated bed hydroprocessing technologies, utilizing different catalyst systems for the ebullated bed and fixed bed reaction stages to produce a better quality product from residue hydrocracking. The additional interstage and/or terminal stage processing using upflow reactors and/or reactor/strippers may extend residue conversion limits, typically 55% to 75%, up to about 90% or greater. Further, such processing may allow the first ebullated bed hydrocracking stage (and additional stages) to be operated at high temperature and high space velocity. Such processing may simultaneously (or sequentially) strip the ebullated bed reactor liquid product while further stabilizing the product via additional conversion of asphaltenes. Further, such processing may reduce unit investment by integrating ebullated and fixed bed hydroprocessing into a common gas cooling, purification, and compression loop. The improved products and decreased sedimentation may provide for reduced cleaning frequencies (lower operating costs and extended run lengths).

Processes disclosed herein may additionally be readily integrated into existing designs. For example, an intermediate or terminal vapor-liquid separator may be converted to a reactor/stripper via modification of the vessel internals. As another example, an upflow reactor may be readily inserted between an ebullated bed hydrocracking stage and an intermediate or terminal vapor-liquid separator.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A process for upgrading residuum hydrocarbons and decreasing tendency of the resulting products toward asphaltenic sediment formation in downstream processes, the process comprising:

a. contacting a residuum hydrocarbon fraction and hydrogen with a hydroconversion catalyst in a hydrocracking reaction zone comprising one or more ebullated bed reactors to convert at least a portion of the residuum hydrocarbon fraction to lighter hydrocarbons;

b. recovering an effluent from the one or more ebullated bed reactors and feeding the effluent to a reactor/stripper, wherein the effluent is introduced to the reactor/stripper intermediate an upper catalyst bed containing a distillate hydrotreating catalyst and a lower catalyst bed containing a resid hydrotreating catalyst;

c. contacting hydrogen and a heavy portion of the effluent with the resid hydrotreating catalyst in the lower catalyst bed, wherein the resid hydrotreating catalyst is in the form of spheres with an average size in the range from 1/32 inch to 1/8 inch and having an average pore size in the range of 125 to 225 Angstroms;

d. contacting hydrogen and a light portion of the effluent with the distillate hydrotreating catalyst in the upper catalyst bed; and e. recovering two or more hydrocarbon fractions from the reactor/stripper.

2. The process of claim 1, wherein the resid hydrotreating catalyst comprises one or more elements selected from the group consisting of (1) Group 6 elements, (2) Groups 8-10 elements with an alumina support, and (3) a combination of (1) and (2); wherein the Groups 6 and 8-10 elements make up from 3% to 35% by weight of the resid hydrotreating catalyst.

3. The process of claim 1, wherein the lower catalyst bed comprises two or more layers of catalyst, the uppermost catalyst layer comprising the resid hydrotreating catalyst in the form of spheres, and one or more lower layers comprising denitrification and/or desulfurization catalysts.

4. The process of claim 3, wherein the resid hydrotreating catalyst is a demetallation catalyst.

5. The process of claim 1, wherein the distillate hydrotreating catalyst comprises one or more elements selected from (1) Group 6 elements and (2) Group 8-10 elements, wherein Group 6 elements make up from 5% to 25% by weight and Groups 8-10 elements make up from 0.5% to 10% by weight of the catalyst.

6. The process of claim 1, wherein the hydrocracking reaction zone comprises one or more ebullated bed reactors, where multiple reactors may be contained in series, parallel, or a combination thereof.

7. The process of claim 6, further comprising operating the one or more ebullated bed reactors at a hydrogen partial pressures of 70 to 170 bara, temperatures of 380° C. to 450° C., and a LHSV of 0.15 to 2.0 $h^{-1}$.

8. The process of claim 1, further comprising quenching the effluent recovered from the hydrocracking reaction zone with at least one of an aromatic diluent and a hydrogen-containing gas stream.

9. A process for upgrading residuum hydrocarbons and decreasing tendency of the resulting products toward asphaltenic sediment formation in downstream processes, the process comprising:

a. contacting a residuum hydrocarbon fraction and hydrogen with a hydroconversion catalyst in a hydrocracking reaction zone comprising one or more ebullated bed reactors to convert at least a portion of the residuum hydrocarbon fraction to lighter hydrocarbons;

b. recovering a first effluent from the one or more ebullated bed reactors;

c. contacting hydrogen and the first effluent in an upflow reactor containing a resid hydrotreating catalyst suitable for hydrotreating a hydrocracked effluent, the catalyst being in the form of spheres with an average size in the range from 1/32 inch to 1/8 inch with an average pore size in the range of 125 to 225 Angstroms;

d. recovering a second effluent from the upflow reactor;

e. contacting hydrogen and at least a portion of the second effluent in a first hydrotreating reaction bed with a resid hydrotreating catalyst suitable for hydrotreating a hydrocracked effluent;

f. contacting hydrogen and at least a portion of the second effluent in a second hydrotreating reaction bed with a distillate hydrotreating catalyst suitable for hydrotreating a hydrocracked effluent;

wherein steps (e) and (f) are performed concurrently in a reactor/stripper having the resid hydrotreating catalyst contained in a lower portion of the reactor/stripper, and having the distillate hydrotreating catalyst contained in an upper portion of the reactor/stripper, and g. recovering two or more hydrocarbon fractions from the reactor/stripper.

10. The process of claim 9, wherein the resid hydrotreating catalyst in the upflow reactor comprises one or more elements selected from the group consisting of (1) Group 6 elements, (2) Groups 8-10 elements with an alumina support, and (3) a combination of (1) and (2); wherein the Groups 6 and 8-10 elements make up from 3% to 35% by weight of the resid hydrotreating catalyst.

11. The process of claim 9, wherein the resid hydrotreating catalyst in the reactor/stripper comprises one or more elements selected from the group consisting of (1) Group 6 elements, (2) Groups 8-10 elements with an alumina support, and (3) a combination of (1) and (2); wherein the Groups 6 and 8-10 elements make up from 3% to 35% by weight of the resid hydrotreating catalyst.

12. The process of claim 9, wherein the upflow reactor comprises two or more layers of catalyst, the lowermost catalyst layer comprising the resid hydrotreating catalyst in the form of spheres, and one or more upper layers comprising denitrification and/or desulfurization catalysts.

13. The process of claim 12, wherein the resid hydrotreating catalyst is a demetallation catalyst.

14. The process of claim 9, wherein the distillate hydrotreating catalyst further comprising one or more elements selected from (1) Group 6 elements and (2) Group 8-10 elements, wherein Group 6 elements make up from 5% to 25% by weight and Groups 8-10 elements make up from 0.5% to 10% by weight of the catalyst; and operating the distillate hydrotreating reaction bed at a liquid hourly space velocity of 1.6 $h^{-1}$ to 2.5 $h^{-1}$.

15. A process for upgrading residuum hydrocarbons and decreasing tendency of the resulting products toward asphaltenic sediment formation in downstream processes, the process comprising:

a. heating a residuum hydrocarbon fraction in a first feed heater and a hydrogen feed in a second feed heater;

b. contacting the heated residuum hydrocarbon fraction and the heated hydrogen with a first hydroconversion catalyst in a first hydrocracking reaction zone comprising one or more ebullated bed reactors to convert at least a portion of the residuum hydrocarbon fraction to lighter hydrocarbons and recover a first hydrocracked effluent, the hydroconversion catalyst comprising a porous refractory base of alumina, silica, phosphorous, or combination thereof;

c. quenching the first hydrocracked effluent with at least one of an aromatic diluent and a hydrogen-containing gas stream;

d. contacting the quenched first hydrocracked effluent in an upflow reactor with a first, spherical, resid hydrotreating catalyst to form a first hydrotreated product;

e. feeding the first hydrotreated product to a first reactor/stripper to concurrently:

separate the effluent to recover two or more hydrocarbon fractions comprising at least a heavy hydrocarbon fraction and a light hydrocarbon fraction;

contact hydrogen and the heavy hydrocarbon fraction with a second resid hydrotreating catalyst contained in a lower portion of the reactor/stripper;

contact hydrogen and the light hydrocarbon fraction with a first distillate hydrotreating catalyst contained in an upper portion of the reactor/stripper; and recover a first overheads vapor fraction comprising distillate hydrocarbons and a first bottoms liquid fraction;

f. contacting hydrogen and the first bottoms liquid fraction with a second hydroconversion catalyst, which may be the same or different than the first hydroconversion catalyst, in a second hydrocracking reaction zone comprising one or more ebullated bed reactors to convert at least a portion of the first bottoms liquid fraction to lighter hydrocarbons and recover a second hydrocracked effluent;

g. quenching the second hydrocracked effluent with at least one of an aromatic diluent and a hydrogen-containing gas stream, which may be the same or different than the aromatic diluent and hydrogen-containing gas stream of step (c);

h. contacting hydrogen and the quenched second hydrocracked effluent in a second upflow reactor with a third, spherical, resid hydrotreating catalyst suitable for hydrotreating a hydrocracked effluent to form a hydrotreated product;

i. feeding the hydrotreated product to a second reactor/stripper to concurrently:

separate the effluent to recover two or more hydrocarbon fractions comprising at least a second heavy hydrocarbon fraction and a second light hydrocarbon fraction;

contact hydrogen and the second heavy hydrocarbon fraction with a fourth resid hydrotreating catalyst contained in a lower portion of the second reactor/stripper; and contact hydrogen and the second light hydrocarbon fraction with a second distillate hydrotreating catalyst contained in an upper portion of the second reactor/stripper; and recover a second overheads vapor fraction comprising distillate hydrocarbons and a second bottoms liquid fraction;

j. combining the first overheads vapor fraction and the second overheads vapor fraction to form a vapor product;

k. feeding the second bottoms liquid fraction to a flash vessel producing a third overheads vapor fraction and a third heavy hydrocarbon fraction.

16. The process of claim 15, wherein the second resid hydrotreating catalyst contained in the lower portion of the reactor/stripper comprises one or more of a denitrification catalyst or a desulfurization catalyst.

17. The process of claim 15, wherein the first resid hydrotreating catalyst contained in the upflow reactor is a demetallation catalyst.

18. The process of claim 15, wherein the first and second hydrocracking reaction zones are operated at an overall residue conversion in the range from about 50 wt % to about 85 wt %.

19. The process of claim 15, wherein the fourth resid hydrotreating catalyst contained in the lower portion of the reactor/stripper comprises one or more of a denitrification catalyst or a desulfurization catalyst.

20. The process of claim 15, wherein the third resid hydrotreating catalyst contained in the second upflow reactor is a demetallation catalyst.

* * * * *